United States Patent [19]

Palka

[11] 4,190,929

[45] Mar. 4, 1980

[54] PLASTIC HINGE

[75] Inventor: James J. Palka, Arlington Heights, Ill.

[73] Assignee: General Bathroom Products, Inc., Elk Grove Village, Ill.

[21] Appl. No.: 12,863

[22] Filed: Feb. 16, 1979

[51] Int. Cl.[2] ..... E05D 5/12

[52] U.S. Cl. ..... 16/169; 49/388; 312/245; 16/176

[58] Field of Search ..... 16/168, 169, 176; 280/515; 49/388; 312/245

[56] References Cited

U.S. PATENT DOCUMENTS

| | | | |
|---|---|---|---|
| 1,190,603 | 7/1916 | Squires | 16/169 |
| 2,686,684 | 8/1954 | Eberly et al. | 280/515 |
| 2,926,382 | 3/1960 | Kuese et al. | 16/176 |
| 2,997,734 | 8/1961 | Dyer | 16/169 |
| 3,349,430 | 10/1967 | Rosenvold et al. | 16/169 |
| 3,962,750 | 6/1976 | Buss et al. | 16/168 |

*Primary Examiner*—Andrew V. Kundrat

*Attorney, Agent, or Firm*—Rummler & Snow

[57] ABSTRACT

A plastic hinge comprising a leaf having a knuckle extending the length of the leaf, and partially open, with a boss therein positioned substantially medially of the ends of the knuckle, and an elongated pin therein terminating in a right angled arm, said pin having an annular groove therein arranged to cooperate with the detent in the knuckle.

2 Claims, 8 Drawing Figures

PLASTIC HINGE

SUMMARY OF THE INVENTION

An inexpensive all-plastic hinge having a single leaf and a knuckle extending the length of said leaf and partially open, a boss in said knuckle positioned substantially medially of the ends thereof and extending outwardly of the entire circumference of said knuckle, a pin of a length greater than the knuckle and terminating in a right angled arm, an annular groove in said pin cooperating with said boss in said knuckle to support the pin in operative position and to release the pin in inoperative position.

DETAILED DESCRIPTION OF THE DRAWINGS

Figure 1:
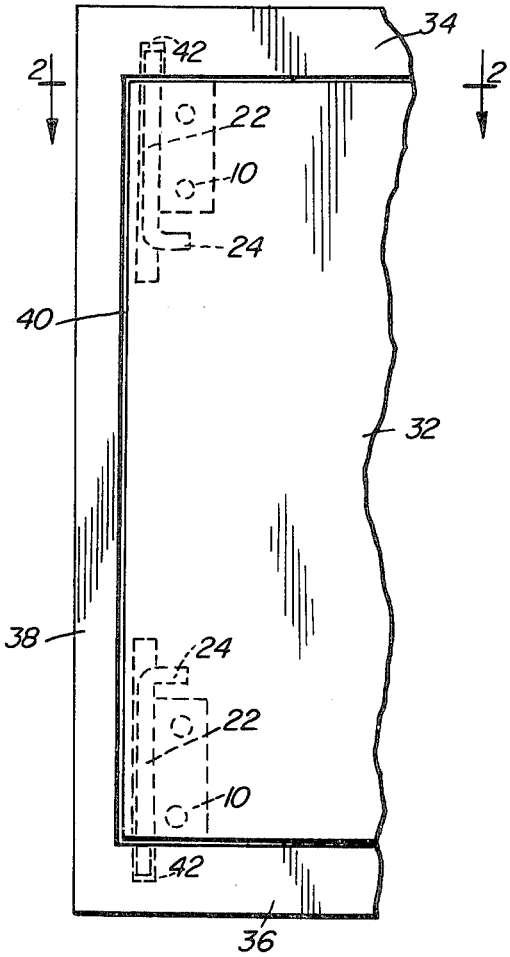
FIG. 1 is a partial front elevational view of a cabinet door positioned in its frame with the hinge of the present invention shown in dash outline.

The all-plastic hinge of the present invention comprises a plate 10 having a pair of spaced perforations 12, 14 for the reception of screws 16.

A split knuckle 18 is integrally formed on one side edge of the plate 10 extending the entire length of the plate 10 and to one side thereof. This combination thus forms a leaf. The inner wall of the knuckle is provided with a boss 20 extending around the inner circumference of the knuckle. The preferred length of the plate 10 and knuckle 18 is approximately 2.00 inches with a width of approximately 1.00 inches. The inner radius of the knuckle is approximately 0.095 inches.

The boss 20 has a radius of about 0.005 inches and extends inwardly of the inner wall of the knuckle approximately 0.010 inches and medially of the ends of said knuckle.

The pin 22 has a length of about 3.000 inches and a diameter of about 0.187 inches. The right angled arm 24 has a length of about 0.625 inches.

An annular groove 26 is positioned in the pin 22 and is of a size to readily be engaged and disengaged with the boss 20 in the knuckle 18. The groove is spaced approximately 1.718 inches from the free end 30.

The usual cabinet frame for the door 22 comprises an upper front wall 34, a lower front wall 36, a side front wall 38 and opposite front wall is usually identical to side wall 38 but is not shown in the drawings. The upper and lower front wall edges are provided with opposed aligned bores 42.

Figure 2:
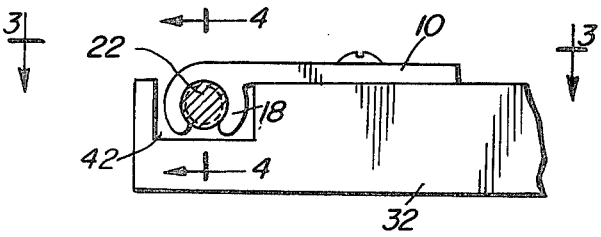
FIG. 2 is a top elevational view taken on the lines 2—2 of FIG. 1.
Figure 3:
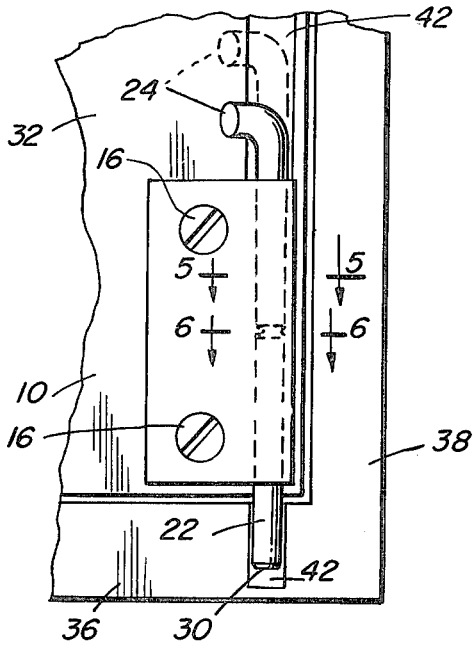
FIG. 3 is an elevational view taken on the lines 3—3 of FIG. 2.
Figure 4:
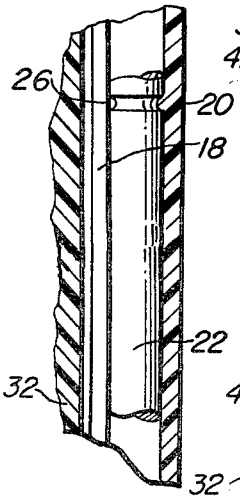
FIG. 4 is a cross-sectional view taken on the lines 4—4 of FIG. 2 but showing the pin in full lines.
Figure 5:
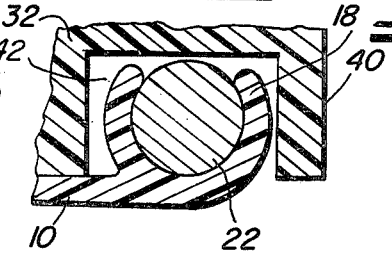
FIG. 5 is a cross-sectional view taken on the lines 5—5 of FIG. 3.
Figure 6:
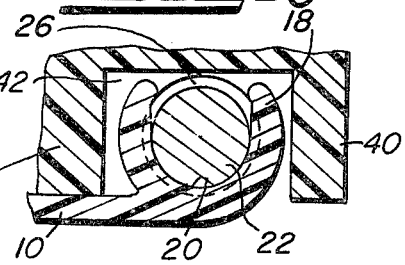
FIG. 6 is a cross-sectional view taken on the lines 6—6 of FIG. 3.
Figure 7:
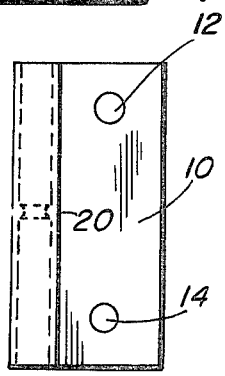
FIG. 7 is a front elevational view of the hinge leaf.
Figure 8:
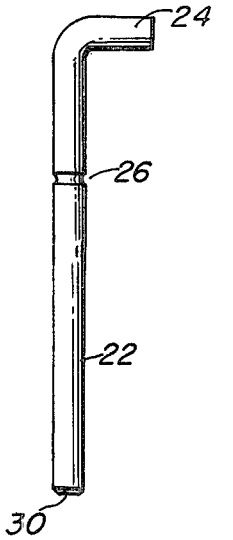
FIG. 8 is a front elevational view of the pin.

In use, the pair of plates 10 are secured adjacent the upper and lower edges of a door 32, as an example, and along the side wall 40, as shown in FIGS. 1 and 3, with the pin therein and held by the boss 20 in groove 26. As shown in FIGS. 2 and 3, the knuckles 18 seat in elongated grooves 44 in the inner faces of the door 22. Thus the handle 24 of the pins will assume the position shown in dash outline as seen in FIG. 3. Both handles 24 extend toward each other, as shown in FIG. 1. With the door in place, the handles will be forced towards the bores 42 until the boss 20 seats in groove 26.

The plastic employed is preferably polycarbonate and because the knuckle contains the split, there will be a slight give therein to allow the pin to shift as explained hereinabove.

Although but one specific embodiment of this invention is herein shown and described, it will be understood that details of the construction shown may be altered or omitted without departing from the spirit of the invention as defined by the following claims.

I claim:

1. An all-plastic hinge for a door in a cabinet having a perforation adjacent the front upper and lower front frames, comprising a single plate secured to the rear of the door and a single split knuckle, a boss positioned medially of the ends of said knuckle and extending inwardly of the inner surface of said knuckle and around the inner surface thereof, a pin, an integral handle on one end of said pin extending at right angles to said pin, an annular groove in said pin cooperating with said boss in said knuckle, and the end opposite said handle extending well beyond the upper end of said knuckle when in operative position and in the perforation of the cabinet.

2. The device according to claim 1 wherein said pin is held in said knuckle by said annular groove when said plate is in operative position.

* * * * *